United States Patent [19]

McCray

[11] 4,215,885

[45] Aug. 5, 1980

[54] PIVOTABLE HATCH ADJUSTER

[76] Inventor: Robert J. McCray, 1789 Pitcairn Dr., Costa Mesa, Calif. 92626

[21] Appl. No.: 924,494

[22] Filed: Jul. 14, 1978

[51] Int. Cl.[3] ..... E05C 17/30

[52] U.S. Cl. ..... 292/338

[58] Field of Search ..... 403/115, 125, 135, 142; 292/262, 276, 338, 339

[56] References Cited

U.S. PATENT DOCUMENTS

| | | | |
|---|---|---|---|
| 778,821 | 12/1904 | Duryea | 403/115 |
| 1,044,771 | 11/1912 | Gaskill | 403/135 |
| 1,601,524 | 9/1926 | Gibbons | 292/338 |
| 2,064,405 | 12/1936 | Benator | 292/262 X |
| 2,516,688 | 7/1950 | Flumerfelt | 403/125 |
| 2,527,736 | 10/1950 | Johnson | 292/276 |
| 3,480,247 | 11/1969 | Waner | 292/338 |

*Primary Examiner*—Richard E. Moore

*Attorney, Agent, or Firm*—William I. Beach

[57] ABSTRACT

An improved hatch adjuster has a telescopic arm rotatably connected to a hatch cover at one end and the other end pivotably connected to a hatch coaming wherein the pivotable member includes an open end socket in which a ball member is pivotably seated and retained therein by a retaining screw to comprise a ball and socket joint adapted to support in adjustable alignment a raised hatch cover.

1 Claim, 8 Drawing Figures

PIVOTABLE HATCH ADJUSTER

BACKGROUND OF THE INVENTION

1. Field of the Invention

The present invention relates to hatch adjusters which are connected to a hatch assembly for supporting the hatch cover in open extended position and more particularly that which provides pivotal adjustment for eliminating the bind in hatch alignment.

2. Description of the Prior Art

The hatch adjusters commonly used today are mostly of the type referred to as window adjusters. The conventional window adjuster generally consists of an elongated tube within which a rod is reciprocally extended and retracted upon opening and closing of the hatch. The opposite ends of the tube and rod are rotatably mounted to the hatch cover and to the hatch cut-out in the deck or the hatch coaming on the deck of a boat. In an optimum arrangement wherein the hatch cover is hinged in proper alignment with the coaming the conventional adjuster is adequate to fulfill the hatch function.

However, because of the way many hatches are constructed or cut out of the deck of a boat a basic alignment problem exists today. The separately constructed hatch seldom fits or aligns to the cut-out already made in the deck. Since the conventional adjuster rotates essentially in a fixed direction there is no allowance for misalignment of hatch and coaming. This causes the conventional adjuster to be pulled free of its mounting on the inside of the hatch cut-out or coaming. Sometimes the hatch cover will simply bend or refuse to close entirely because of the excessive angle required. This also occurs because many forward hatches are no longer square but follow the contour of the bow of the boat making the different angles of travel in the closure of the hatch at least 15°. Consequently, the hatch will not close straight down. As a result of the lack of closure and proper seal when the deck is awash, water will sweep through the hatch opening.

In light of the foregoing it is the object of the present invention to provide a pivotal hatch adjuster which will solve the above problems. The present invention includes a unique pivoting ball and socket joint which corrects and compensates for a substantial misalignment of a hatch cover closure with a hatch cut-out or coaming. It can be manufactured readily and inexpensively and provides simple but effective means for operating many types of hatch closures.

SUMMARY OF THE INVENTION

In carrying out the principles of the present invention in accordance with a preferred embodiment thereof an improved hatch adjuster has a tube within which a rod is telescopically received including a set screw for jamming the rod in desired position within the tube. The outer end of the rod is adapted for a rotatable connection and the outer end of the tube for a pivotal connection so as to provide adjustable alignment and support for a raised hatch cover. The improvement comprises a generally cylindrical socket member connected to the outer end of the tube. The socket member has a bore extending into a side portion wherein the inner end of the bore has a hemispherical bearing surface. A ball member is mounted witin the bore and has a bearing surface adapted for pivotal movement in registry with the bearing surface of the bore. A mounting bracket has one end of an upright stem connected to the ball member. Means are provided to restrict the passageway so as to prevent the separation of the ball member from pivotal contact with the bearing surface of the bore.

BRIEF DESCRIPTION OF THE DRAWING

Referring to FIG. 2 it can be seen that the improved hatch adjuster 10 includes a tube 11 in which a rod 12 is slidably retained. A coupling element 13 is connected at one end to the outer end of rod 12. The other end of coupling 13 is reduced to a circular flange having an aperture through the wall of the flange. A mounting bracket 14 is rotatably secured to coupling 13 by a pin 15 which extends through the yoke portion of the bracket. Mounting bracket 14 is adapted to be fastened to a hatch cover 16. A set screw assembly 17 includes a cylindrical barrel 18 which has a central bore mounted on the inner end of tube 11. A semi-circular groove extends from a side of barrel 18 into the center of the central bore. An aperture extends from inside of the central bore through the wall of barrel 18 on the side wall of the semi-circular groove. A ring fitting is disposed in the groove to encircle rod 12 and has a threaded stem 19 extending through the aperture in the wall of barrel 18. A circular serrated nut 20 is threadedly mounted on stem 19 and when rotated clockwise sufficiently against the side of barrel 18 the ring fitting jams rod 12 within tube 11. It is to be pointed out that FIG. 2 discloses the outside configuration of the set screw assembly 17 and the barrel 18, stem 19 and the serrated nut 20 are the only elements identified by character numbers.

Figure 3:
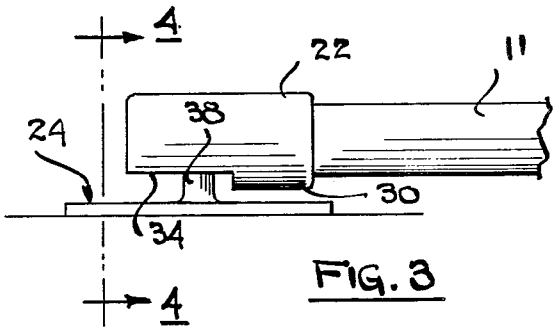
FIG. 3 is a partial side view of the pivotal end connection of the present invention.
Figure 4:
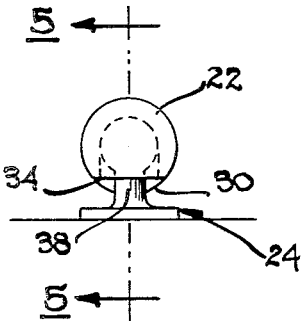
FIG. 4 is an end view of FIG. 3 taken along line 4—4.
Figure 5:
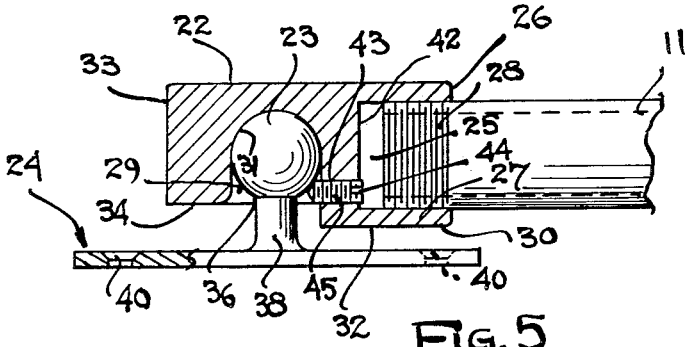
FIG. 5 is a partial cross-sectional view taken along line 5—5 of FIG. 4 showing in detail the means for retaining the ball member in pivotal contact within the open end bore in the socket member, FIG. 6 discloses an end view of a modified form of the present invention.
Figure 8:
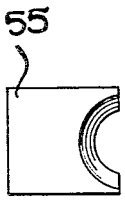
FIG. 8 is a fragmented view of the retaining key shown in FIG. 7 for supporting the spherical element within the bore.

On the outer end of tube 11 is connected a ball and socket joint 21. Joint 21 includes a socket member 22 and a ball member 23 connected to a mounting bracket 24 (reference FIG. 3). Socket 22 is constructed of a portion of a rod which has a bore 25 in the front end 26. Bore 25 has an internal threaded portion 27 engaged with external thread 28 on the outer end of tube 11. A second bore 29 extends into the bottom side 30 of socket 22 and the end of bore 29 is shaped into a hemispherical bearing surface 31. A portion of bottom side 30 extending from bore 29 to the front end 26 of socket 22 is removed to provide a flat section 32. Another portion of side 30 extending from bore 29 to rear end 33 of socket 22 is also removed to provide flat section 34.

The ball member 23 has a spherical bearing surface seated in hemispherical bearing surface 31 upon which socket 22 can rotate and pivot upwardly or or downwardly. The lower portion 36 of ball 23 is connected to upper end of stem 38 which has a lower end connected to the flange of mounting bracket 24. The flange has a pair of holes 40 for fastening bracket 24 to hatch coaming 41.

On the inner end 42 of the first bore 25 is a third but smaller diameter bore 43 extending longitudinally into the first bore 29. A threaded retaining screw 44 is threadedly engaged in bore 43 and has a rounded front end 45 in bearing contact with lower portion 36 of ball 23 adjacent to its connection to upper end of stem 38 of bracket 24. The retaining screw 44 extending into bore 29 provides a restricted passageway and although adjusted to bear against the lower portion 36 of ball 23 allows socket 22 to rotate and pivot freely yet will not permit ball 23 to separate from bearing 31 within bore 29.

The effective arrangement of inserting a ball into an open end bore in a socket structure for pivotal movement therein and securing both members together with a retaining screw inserted in the passageway of the bore is expedient and from the standpoint of manufacturing simplicity and cost saving is also very efficient.

Figure 6:
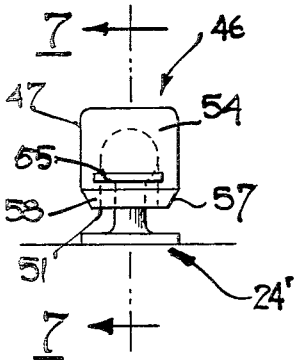
Figure 7:
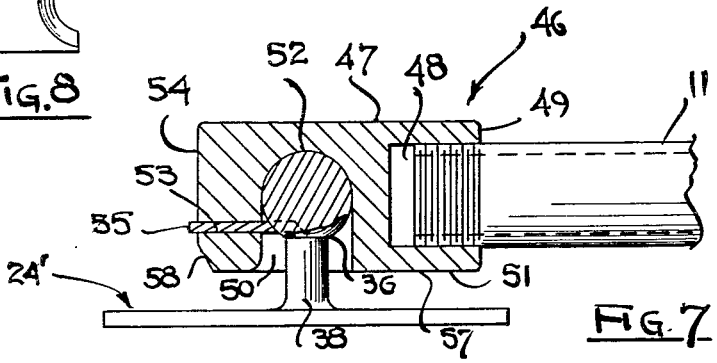
FIG. 7 is a partial cross-sectional view taken along line 7—7 of FIG. 6 showing in detail the modified means for retaining the ball member in pivotal contact within the open end bore in the socket member.

A modified form of the present invention is illustrated in FIGS. 6 and 7 showing a ball and socket joint 46. The socket element 47 is constructed of a portion of a bar of substantially square cross-section. Socket 47 also has a bore 48 in the front end 49 adapted to be threadedly engaged with the outer end of tube 11. Also, like socket member 22, the modified socket element 47 has a second bore 50 which extends in a bottom side 51 and the inner end is formed into a hemispherical bearing surface 52. Since the second bore 29 and inner bearing surface 31 of socket 22 can be readily reproduced to the same diameter and depth in socket 47 the ball member 23 mounted on bracket 24 can be supplemented for the ball and mounting bracket in bore 50 of the modified ball and socket joint 46.

The socket element 47 is further modified to include an open ended interior keyway 53 which extends longitudinally from the rear end 54 of socket 47 into the second bore 50. A retaining key 55 has an annular front edge shaped to engage the lower portion 36 of the ball element 23 and is wedged in keyway 53. Key 55 extends into bore 50 so as to provide a restricted passageway and prevent ball 23 from being releasably moved from pivotal contact with the bearing surface 52 under operating conditions.

Additional modification of socket 47 includes an inwardly extending chamfer 57 along the edge of bottom side 51 and chamfer 58 along the lower edge of rear end 54. Chamfers 57 and 58 are preferably incorporated in bottom side 51 so as to obtain an optimum tilt of socket element 47 on ball 23 without contacting the flange of mounting bracket 24. Obviously, there are other alternatives including a tapered bore rather than one with a straight wall, reducing the diameter of the stem connected to the ball or lengthen the stem so as to move the bottom surface of the socket farther away from the flange of the mounting bracket.

Figure 1:
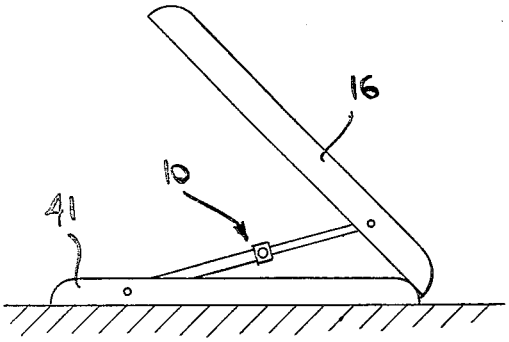
FIG. 1 discloses a side elevational view of a hatch adjuster connected to a hatch coaming and cover.
Figure 2:
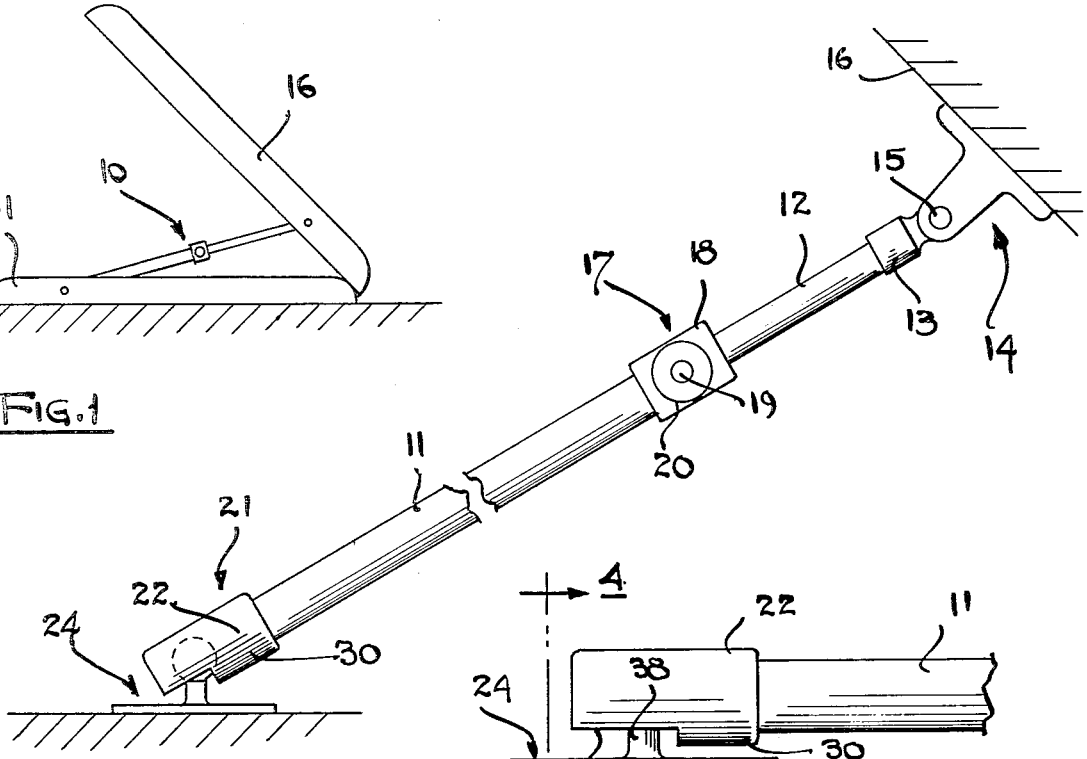
FIG. 2 is a general perspective view of the present invention disclosed herein.

In operating the present invention the hatch adjuster is positioned on the inside of the hatch as shown in FIG. 1. Preferably the ball and socket joint connected to the outer end of tube 11 is fastened to the hatch cut-out or to the coaming if one protrudes above the deck and the mounting bracket at the outer end of rod 12 is rotatably fastened to the hatch cover. When the hatch cover is raised rod 12 is extended in tube 11 while both together rotate about mounting bracket 14 connected to the outer end of rod 12. Therefore, during the time the hatch cover is swinging upwardly, for example, socket 22 is pivoting on ball 23. Further, in the event the hatch cover opens at a side angle displacement which in the case of the conventional hatch adjuster tending to bind the rod within the tube, the socket member 22 can rotate and pivot freely to correct the displacement and allow the rod to slide smoothly within the tube. Then when rod 12 is extended freely on opening of the hatch cover the serrated nut may be rotated until the ring fitting housed in the barrel 18 jams the rod tightly within the tube to secure the hatch cover in open position.

From the description and illustration of the present invention it is obvious that it provides many important advantages which can be utilized effectively by virtue of the unique construction of the ball and socket joint.

The foregoing description is to be clearly understood to be given by way of illustration and example only; that the spirit and scope of the present invention is limited solely by the appended claims.

I claim:

1. An improved hatch adjuster having a tube within which a rod is telescopically received wherein the outer end of the tube is adapted for pivotal connection and the outer end of the rod a rotatable connection including a set screw for jamming the rod in desired position within the tube to provide adjustable alignment and support for a raised hatch cover, the improvement comprising:

a generally cylindrical socket member having a first bore connected to the outer end of said tube, a second bore extending into a side portion of the socket member having an inner end shaped into a hemispherical bearing surface, and a third bore of lesser diameter extending internally in alignment with the first bore for communication with the second bore, a ball member mounted within said second bore having a bearing surface adapted for pivotal movement in registry with the bearing surface of said bore, a mounting bracket having one end of an upright stem connected to the ball member, and a retaining screw for providing a restricted passageway so as to prevent the separation of said ball member from pivotal contact with said bearing surface of said second bore, the retaining screw being threadedly engaged in the third bore and having a round end portion projecting into said second bore in direct bearing with the lower surface of said ball adjacent to the connection with the stem of said bracket, whereby said ball is urged in pivotal contact with the bearing surface of said second bore.

* * * * *